US006549166B2

(12) United States Patent
Bhattacharyya et al.

(10) Patent No.: US 6,549,166 B2
(45) Date of Patent: Apr. 15, 2003

(54) FOUR-PORT PATCH ANTENNA

(75) Inventors: Arun Bhattacharyya, El Segundo, CA (US); Alan Cha, Glendale, CA (US); James McKay, Manhattan Beach, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/935,471

(22) Filed: Aug. 22, 2001

(65) Prior Publication Data

US 2003/0043074 A1 Mar. 6, 2003

(51) Int. Cl.[7] ..... H01Q 1/38
(52) U.S. Cl. ..... 343/700 MS; 343/846
(58) Field of Search ..... 343/700 MS, 846, 343/848, 850, 853; H01Q 1/38

(56) References Cited

U.S. PATENT DOCUMENTS 4,903,033 A * 2/1990 Tsao et al. ..... 343/700 MS
5,043,738 A * 8/1991 Shapiro et al. ..... 343/700 MS
5,124,713 A * 6/1992 Mayes et al. ..... 343/700 MS
5,223,848 A * 6/1993 Rammos et al. ..... 343/700 MS
5,241,321 A * 8/1993 Tsao ..... 343/700 MS
5,880,694 A * 3/1999 Wang et al. ..... 343/700 MS

* cited by examiner

*Primary Examiner*—Hoanganh Le
(74) *Attorney, Agent, or Firm*—Fitch, Even, Tabin & Flannery

(57) ABSTRACT

A patch antenna is disclosed having four ports for circular polarization that suppress the TM-02 mode, resulting in a radiation pattern that is symmetric. The axial ratio performance is consequently superior to that of two-port patch antennas. A four-port patch antenna includes a patch made of an electrically conductive material, a patch substrate coupled to the patch wherein the patch substrate is made of a dielectric material, a ground plane coupled to the patch substrate wherein the ground plane is made of an electrically conductive material having at least four slots formed therein, a feed substrate coupled to the ground plane wherein the feed substrate is made of a dielectric material, and a hybrid network coupled to the feed substrate that includes a right hand circularly polarized port, a left hand circularly polarized port, and two matched terminated ports.

18 Claims, 5 Drawing Sheets

FOUR-PORT PATCH ANTENNA

BACKGROUND OF THE INVENTION

The present invention relates generally to phased array antenna systems. More specifically, but without limitation thereto, the present invention relates to a patch antenna for a phased array antenna system for radiating a circularly polarized wave over a wide frequency band.

A typical phased array antenna used, for example, in code division multiple access (CDMA) communications systems, consists of many array elements arranged in a two-dimensional aperture. An array element commonly used in these phased array antennas has a conductive area or "patch" on one side of a patch substrate made of a dielectric material and a pattern of slots formed in an electrically conductive ground plane on the opposite side of the patch substrate. A hybrid network couples radio frequency signals capacitively to the slots in the ground plane through a feed substrate made of a dielectric material facing the side of the ground plane opposite to the patch substrate. Array elements having this structure are called patch antennas.

A two-port patch antenna element is typically used for dual-band and dual polarization applications. A two-port patch antenna has two input ports or excitation ports. When the first port is driven by a radio frequency signal, the TM-01 mode is excited (for a rectangular patch). When the second port is driven by a radio frequency signal, the TM-10 mode is excited. The TM-01 and the TM-10 modes are mutually orthogonal, and the resonant frequencies may be controlled independently, for example, by changing the length and width of the patch. The polarizations of the TM-01 and the TM-10 modes are also mutually orthogonal.

A disadvantage of two-port patch antennas is that when the first port is driven, not only is the TM-01 mode excited, but also the TM-02, TM-03, etc. modes. The TM-02 mode introduces asymmetry in the radiation pattern of the patch antenna, resulting in axial ratio degradation at angles from the boresight direction.

Another disadvantage of two-port patch antennas besides poor axial ratio performance over a wide frequency band is significant return loss, or reflected power, at the input.

SUMMARY OF THE INVENTION

The present invention advantageously addresses the problems above as well as other problems by providing a patch antenna that has four ports for circular polarization that suppress the TM-02 mode, resulting in a radiation pattern that is symmetric. The axial ratio performance is consequently superior to that of two-port patch antennas.

In one embodiment, the present invention may be characterized as a patch antenna that includes a patch made of an electrically conductive material, a patch substrate coupled to the patch wherein the patch substrate is made of a dielectric material, a ground plane coupled to the patch substrate wherein the ground plane is made of an electrically conductive material having at least four slots formed therein, a feed substrate coupled to the ground plane wherein the feed substrate is made of a dielectric material, and a hybrid network coupled to the feed substrate that includes a right hand circularly polarized port, a left hand circularly polarized port, and two matched terminated ports.

In another embodiment, the present invention may be characterized as a phased array antenna for a communications system that includes an array of patch antennas wherein each patch antenna includes a patch made of an electrically conductive material, a patch substrate coupled to the patch wherein the patch substrate is made of an electrically insulating material, a ground plane coupled to the patch substrate wherein the ground plane is made of an electrically conductive material having at least four slots formed therein, a feed substrate coupled to the ground plane wherein the feed substrate is made of a dielectric material, and a hybrid network coupled to the feed substrate that includes a right hand circularly polarized port, a left hand circularly polarized port, and two matched terminated ports.

BRIEF DESCRIPTION OF THE DRAWINGS

The above and other aspects, features and advantages of the present invention will be more apparent from the following more specific description thereof, presented in conjunction with the following drawings wherein.

Corresponding reference characters indicate corresponding elements throughout the several views of the drawings.

DETAILED DESCRIPTION OF THE DRAWINGS

The following description is presented to disclose the currently known best mode for making and using the present invention. The scope of the invention is defined by the claims.

Figure 1:
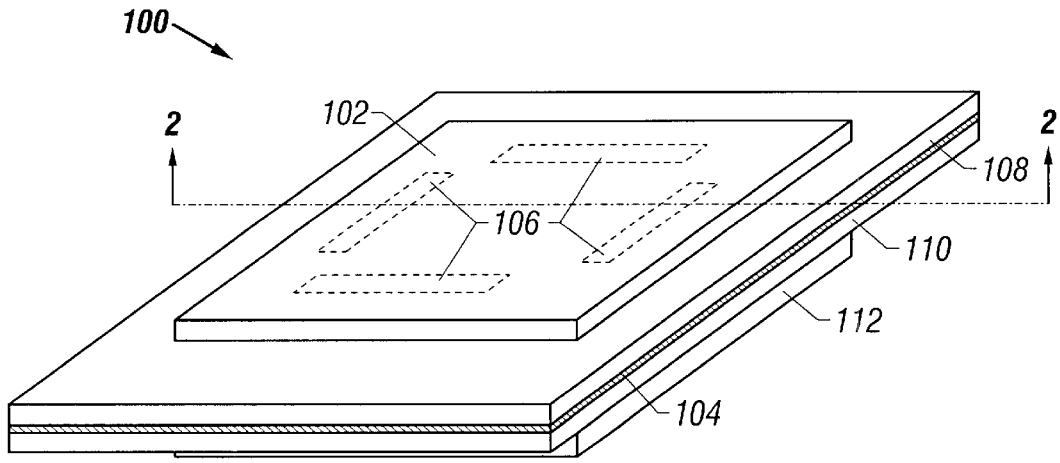
FIG. 1 is a diagram of a four-port patch antenna according to an embodiment of the present invention.

FIG. 1 is a top view diagram of a four-port patch antenna 100 according to an embodiment of the present invention. The four-port patch antenna 100 is capable of radiating a circularly polarized wave with good axial ratio performance over a wide band of frequencies and may be used in an antenna array that includes multiple patch antennas.

Shown in FIG. 1 are a patch 102, a ground plane 104, four slots 106, a patch substrate 108, a feed substrate 110, and a hybrid network 112. In this example, dimensions are given for the patch antenna 100 corresponding to a center frequency 2 GHz. Other center frequencies may be selected by scaling the dimensions from the 2 GHz example proportionally to the desired wavelength. For example, the dimensions of a four-port patch antenna for 4 GHz would be half the dimensions for 2 Ghz. Such scaling may be performed according to techniques well known in the art.

The patch 102 is preferably made of an electrically conductive material formed on the patch substrate 108. By way of example, to radiate at a center frequency of 2 GHz, the patch 102 has the dimensions of 5.65 cm×5.65 cm. The spacing between centers of each patch 102 would be about 7 cm in an antenna array of multiple patch antenna elements 100.

The ground plane 104 is preferably a thin layer made of an electrically conductive material formed on the side of the patch substrate 108 opposite the patch 102. The slots 106 are openings formed in the ground plane 104. By way of example, to radiate at a center frequency of 2 GHz, the dimensions of slots 106 are 2.94 cm long by 0.2 cm wide. The slots 106 are formed parallel to and centered on each side of the patch 102. As shown in FIG. 1, each of the slots 106 includes an inside edge and an outside edge. The inside edge extends lengthwise parallel to the outside edge between the outside edge and the center of the patch. The inside edge of each of the slots 106 is 2.3 cm from the center of the patch 102. The tolerance of the slot dimensions is about two to three thousandths of a centimeter.

Figure 2:
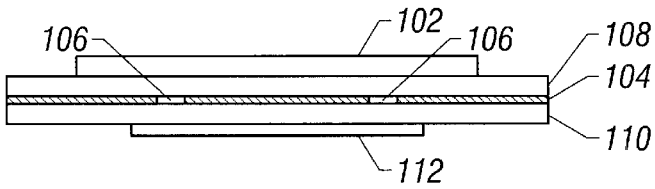
FIG. 2 is a cross-sectional view of the patch antenna of FIG. 1 taken along line 2—2.

FIG. 2 is a cross-sectional view of the patch antenna of FIG. 1 taken along line 2—2. Shown in FIG. 2 are the patch 102, the ground plane 104, two of the four slots 106, the feed substrate 110, and the hybrid network 112.

The patch substrate 108 is preferably made of a dielectric material that has a low dielectric constant, for example, 2.5 or lower, because a low dielectric constant affords high radiation efficiency over a wide frequency band. Similar patch substrates are also used for conventional two-port patch antennas. In this example, the patch substrate 108 has a thickness of 0.5 cm and a dielectric constant of 1.1.

The feed substrate 110 capacitively couples feed signals from the hybrid network 112 to each of the slots 106. The feed substrate 110 is preferably made of a dielectric material having a high dielectric constant, for example, nine or higher. Similar patch substrates are also used for conventional two-port patch antennas. The high dielectric constant reduces the wavelength, thus minimizing the size and the spurious radiation from the hybrid network 212. In this example, the feed substrate 110 has a thickness of 0.159 cm and a dielectric constant of 9.8.

Figure 3:
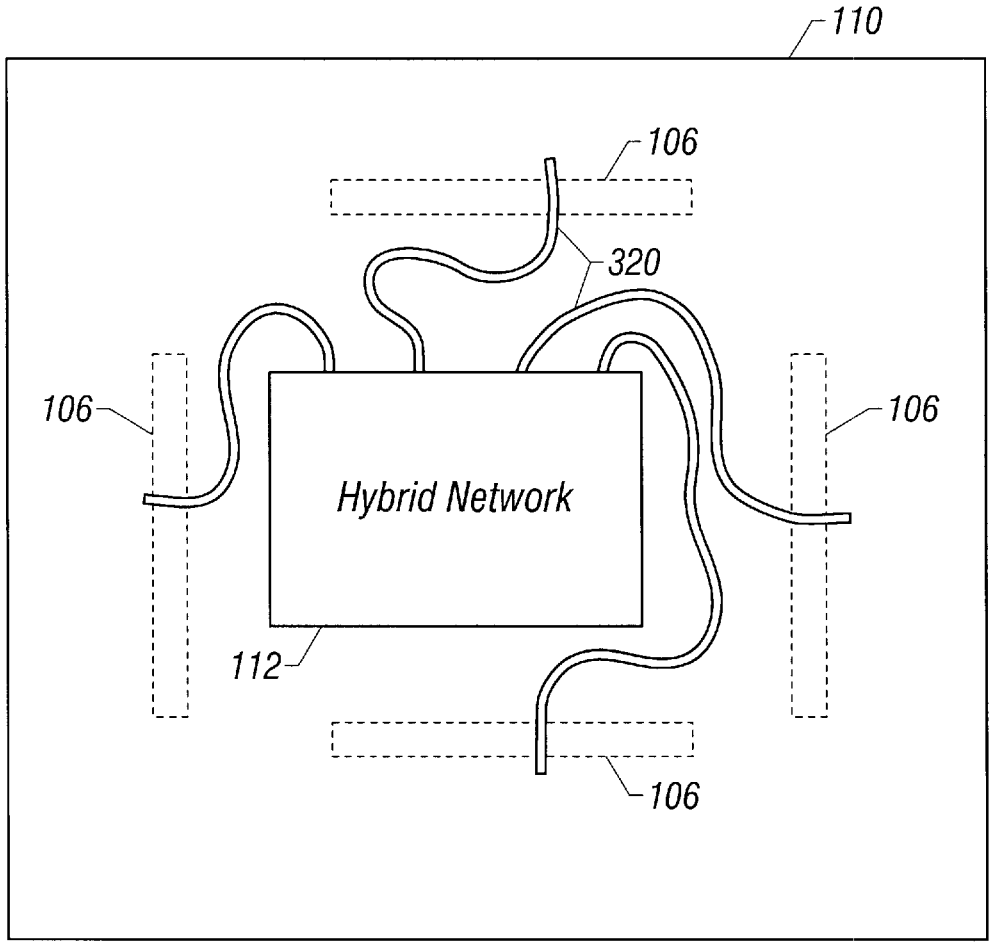
FIG. 3 is a bottom view diagram of the hybrid network for the patch antenna of FIG. 1.

FIG. 3 is a bottom view diagram of the hybrid network 112 for the patch antenna of FIG. 1. Shown in FIG. 3 are the four slots 106, the feed substrate 110, the hybrid network 112, and feed lines 320.

The feed lines 320 connect the hybrid network 112 to the four slots 106 via capacitive coupling through the feed substrate 110. The feed lines 320 are preferably of equal length to maintain equal phase shift from the hybrid network 112 and may be etched in an electrically conductive layer formed on the same side of the feed substrate 110 as the hybrid network 112 opposite the side facing the ground plane 104. The feed lines 320 pass underneath the slots 106 at approximately a right angle to couple signals capacitively to the slots 106 through the feed substrate 110 and terminate at about 0.5 cm beyond the slots 106. The extension of the feed lines 320 beyond the slots 106 compensates for the reactance of the slots 106.

Figure 4:
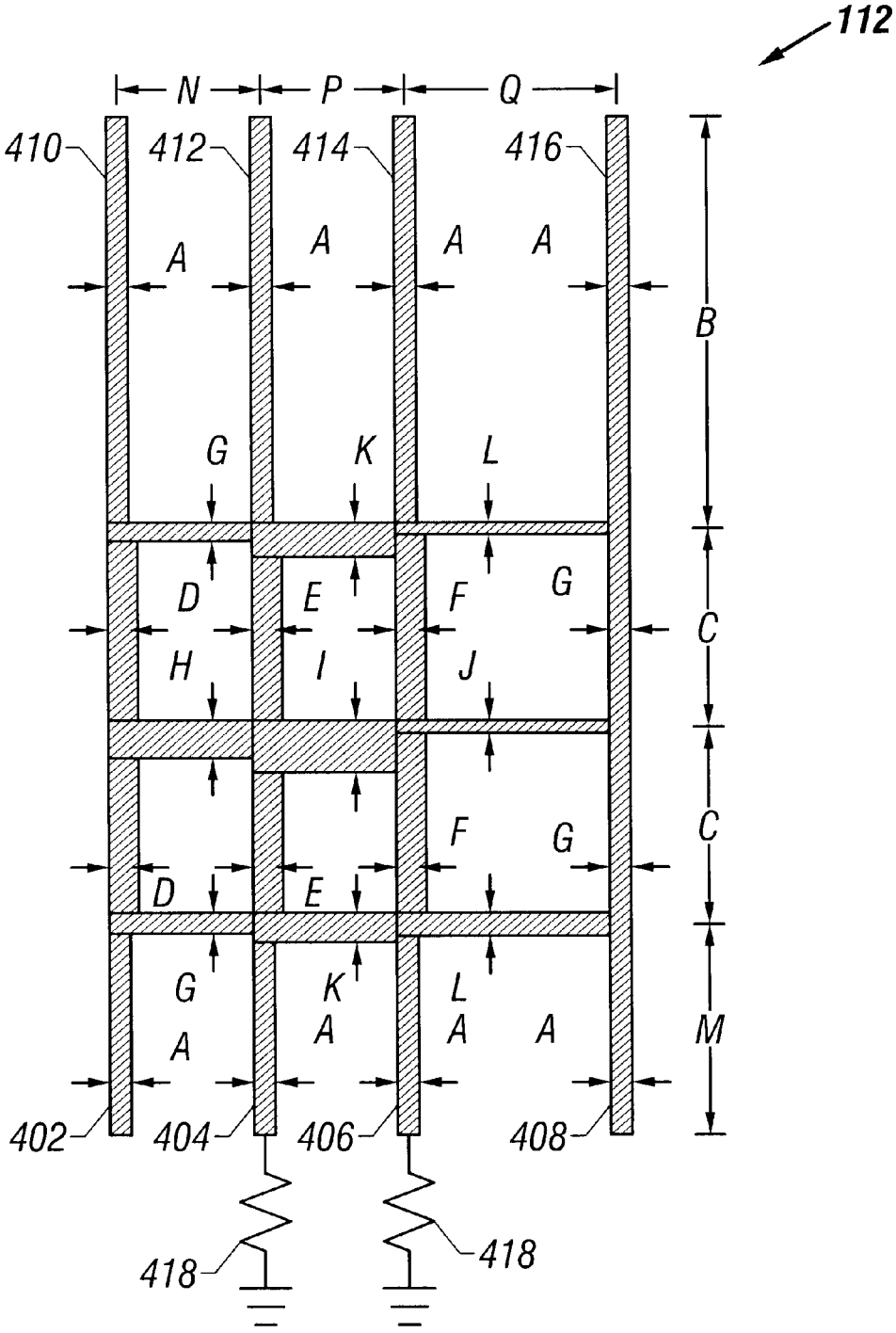
FIG. 4 is a detailed view of the hybrid network for the patch antenna of FIG. 1.

FIG. 4 is a detailed view of the hybrid network 112. The terms "input" and "output" are added in the following example to describe the operation of the patch antenna 100 for transmitting a signal. The terms "input" and "output" may be reversed to describe the operation of the patch antenna 100 for receiving a signal or omitted to mean that the patch antenna 100 may be used for either transmitting or receiving a radio frequency signal.

Shown in FIG. 4 are a right hand circularly polarized input port 402, matched terminated ports 404 and 406, a left hand circularly polarized input port 408, a 0° output port 410, a 90° output port 412, a 180° output port 414, a 270° output port 416, and resistive loads 418.

The right hand circularly polarized input port 402 may be connected to an RF signal source for transmitting a right hand circularly polarized signal or to a receiver input for receiving a right hand circularly polarized signal. Likewise the left hand circularly polarized input port 408 may be connected to an RF signal source for transmitting a left hand circularly polarized signal or to a receiver input for receiving a left hand circularly polarized signal. Both ports may be used independently concurrently. For example, the right hand circularly polarized input port 402 may be connected to an RF signal source for transmitting a right hand circularly polarized signal or to a receiver input for receiving a right hand circularly polarized signal. At the same time, the left hand circularly polarized input port 408 may be connected to an RF signal source for transmitting a left hand circularly polarized signal or to a receiver input for receiving a left hand circularly polarized signal.

The matched terminated ports 404 and 406 are ports so named because they are terminated by the resistive loads 418 to match the port impedance. The resistive loads 418 may be made according to well known resistive film deposition techniques. In this example, the resistance values are each 50 Ohms. Other values of resistance for the resistive loads 418 may be used to suit specific applications.

The 0° output port 410, the 90° output port 412, the 180° output port 414, and the 270° output port 416 are connected respectively to the feed lines 320. The feed lines 320 capacitively couple the hybrid network 112 to the slots 106 through the feed substrate 110.

The dimensions for the hybrid network 112 for the example of a patch antenna having a center frequency of 2 GHz are listed in Table 1 below. The dimensions are scalable according to well known techniques for operating at other center frequencies. The tolerance of the hybrid network dimensions is about seven thousandths of a centimeter.

TABLE 1

| Dimension | cm |
|---|---|
| A | 0.18 |
| B | 1.5 |
| C | 1.809 |
| D | 0.263 |
| E | 0.517 |
| F | 0.227 |
| G | 0.155 |
| H | 0.429 |
| I | 0.599 |
| J | 0.303 |
| K | 0.292 |
| L | 0.212 |
| M | 0.5 |
| N | 1.115 |
| P | 1.029 |
| Q | 1.487 |

When the right hand circularly polarized input port 402 is driven by a radio frequency signal, the TM-01 mode is excited. When the left hand circularly polarized input port 408 is driven by a radio frequency signal, the TM-10 mode is excited. The TM-01 and the TM-10 modes are mutually orthogonal, and the resonant frequencies may be controlled independently, for example, by changing the length and width of the patch. The polarizations of the TM-01 and the TM-10 modes are also mutually orthogonal. In contrast to two-port patch antennas, the TM-02 and higher modes are not excited, resulting in a symmetric radiation pattern, lower reflected power at the input, and superior axial ratio performance.

Table 2 below compares the performance of the four-port patch antenna 100 with a conventional two-port patch antenna.

TABLE 2

| | Return Loss at 0° (Boresight) | Return Loss at 45° Scan | Axial Ratio at 0° | Axial Ratio at 45° Scan |
|---|---|---|---|---|
| Two-port Patch Antenna | −14.0 dB | −9.6 dB | 0.8 dB | 5.5 dB |
| Four-port Patch Antenna | −17.0 dB | −15.0 dB | 1.7 dB | 3.6 dB |

The return loss columns indicate the power reflected back to the input as a ratio of the reflected power divided by the input power. The axial ratio columns indicate the ratio of the major axis to the minor axis of the polarization ellipse. The four-port patch antenna provides superior performance in all columns except the boresight axial ratio.

Figure 5:
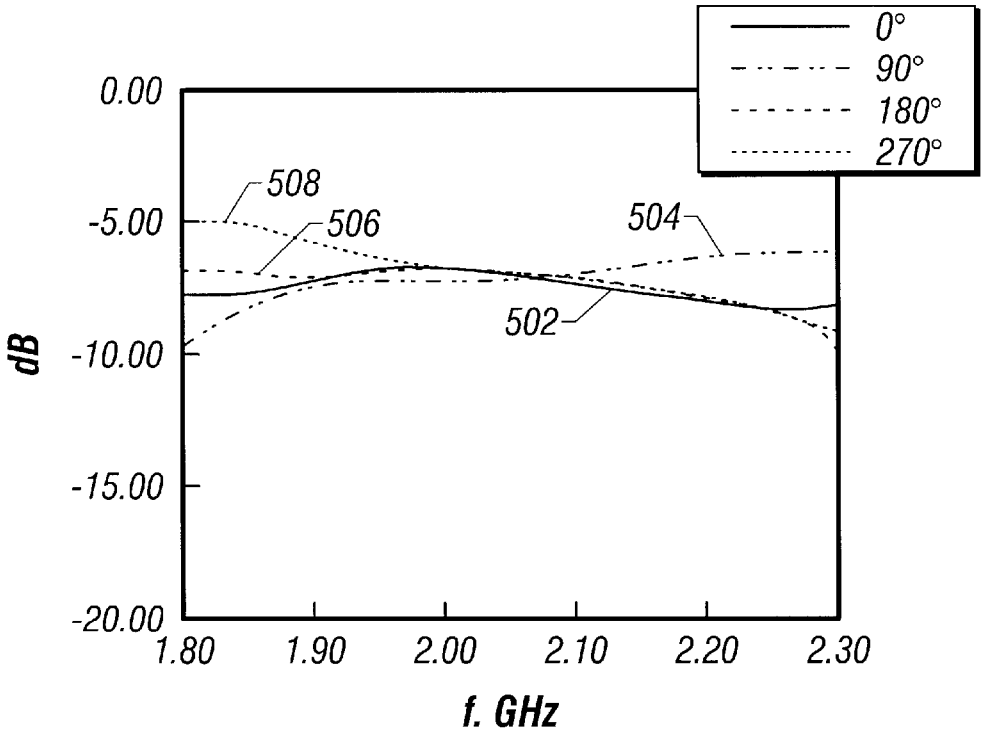
FIG. 5 is a plot of output power vs. frequency for each output port of the patch antenna of FIG. 1.

FIG. 5 is a plot of output power vs. frequency for each output port of the four-port patch antenna of FIG. 1. As shown in FIG. 5, the maximum difference in power between the curves 502, 504, 506, and 508 corresponding to the output ports 410, 412, 414, and 416 in FIG. 4 is less than 5 dB between 1.80 GHz and 2.3 GHz, and less than 2 dB between 1.90 GHz and 2.20 GHz.

Figure 6:
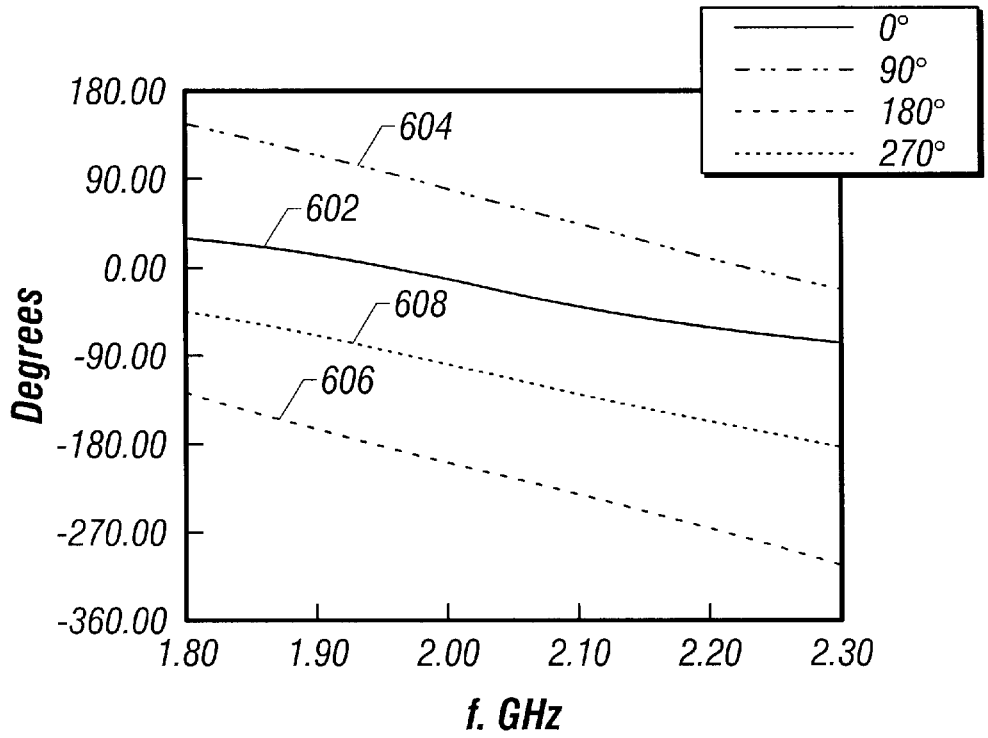
FIG. 6 is a plot of phase vs. frequency for each output port of the patch antenna of FIG. 1.

FIG. 6 is a plot of phase vs. frequency for each of the output ports 410, 412, 414, and 416 in FIG. 4 for the patch antenna of FIG. 1. As shown in FIG. 6, the phase difference between the curves 602, 604, 606, and 608 corresponding to the output ports 410, 412, 414, and 416 remains fairly constant over a wide frequency range.

Figure 7:
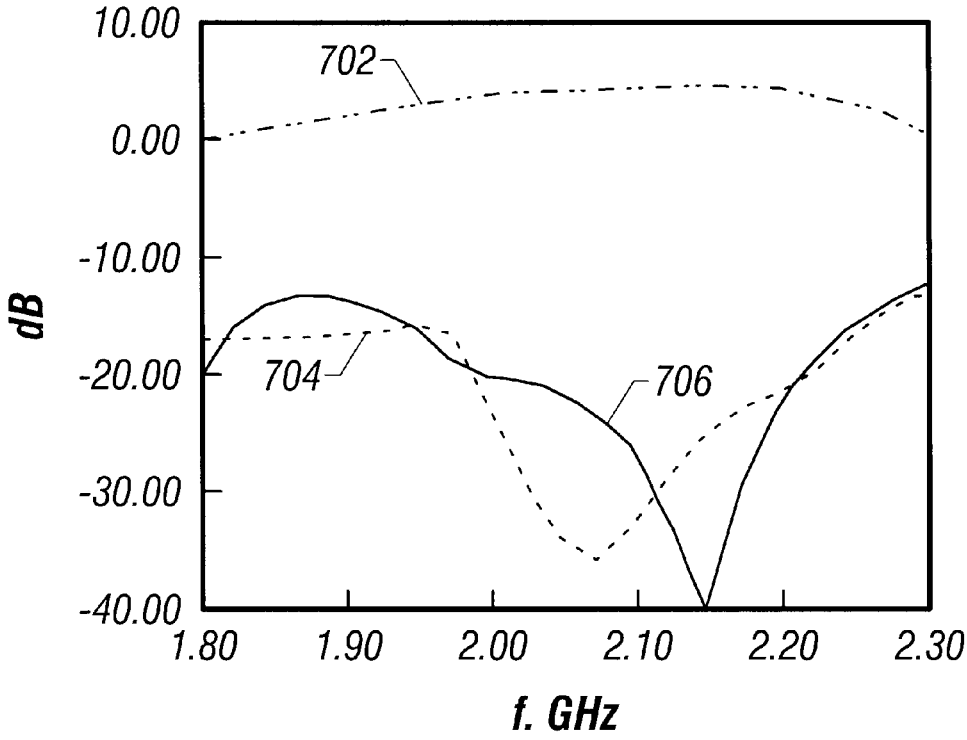
FIG. 7 is a plot of gain, cross-polar level, and return loss vs. frequency for the patch antenna of FIG. 1.

FIG. 7 is a plot of gain 702, cross-polar level 704, and return loss vs. frequency 706 for the patch antenna of FIG. 1. As shown in FIG. 7, the gain is fairly constant over a wide frequency range. The gain 702 is the ratio of power per unit area in the boresight or 0° direction divided by the average power per unit area in all directions. The cross-polar level 704 is the ratio of the power radiated to the opposite polarization divided by the power radiated to the desired polarization. The return loss 706 is the ratio of the power reflected back to the input port divided by the power delivered to the input port.

The four-port patch antenna described above may also be used for both signal transmission and reception of circularly polarized radio frequency signals and provides a substantial improvement in performance over two-port patch antennas.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A patch antenna comprising:

a patch made of an electrically conductive material;

a patch substrate coupled to the patch wherein the patch substrate is made of an electrically insulating material;

a ground plane coupled to the patch substrate wherein the ground plane is made of an electrically conductive material having at least four slots formed therein;

a feed substrate coupled to the ground plane wherein the feed substrate is made of an electrically insulating material; and a hybrid network coupled to the feed substrate wherein the hybrid network comprises:

a right hand circularly polarized port;

a left hand circularly polarized port; and two matched terminated ports coupled to the right hand circularly polarized port and the left hand circularly polarized port.

2. The patch antenna of claim 1 wherein the hybrid network further comprises a 0° port, a 90° port, a 180° port, and a 270° port coupled to the right hand circularly polarized port and the left hand circularly polarized port.

3. The patch antenna of claim 2 further comprising feed lines coupled respectively to the 0° port, the 90° port, the 180° port, and the 270° port.

4. The patch antenna of claim 3 wherein the feed lines have substantially equal length.

5. The patch antenna of claim 1 wherein the feed substrate has a dielectric constant of at least 9.

6. The patch antenna of claim 1 wherein the patch substrate has a dielectric constant of no more than 2.5.

7. A phased array antenna for a communications system comprising:

a patch made of an electrically conductive material;

a patch substrate coupled to the patch wherein the patch substrate is made of a dielectric material;

a ground plane coupled to the patch substrate wherein the ground plane is made of an electrically conductive material in which at least four slots are formed;

a feed substrate coupled to the ground plane wherein the feed substrate is made of a dielectric material; and a hybrid network coupled to the feed substrate wherein the hybrid network comprises:

a right hand circularly polarized port;

a left hand circularly polarized port; and two matched terminated ports coupled to the right hand circularly polarized port and the left hand circularly polarized port.

8. The phased array antenna of claim 7 wherein the hybrid network further comprises a 0° port, a 90° port, a 180° port, and a 270° port coupled to the right hand circularly polarized port and the left hand circularly polarized port.

9. The phased array antenna of claim 8 further comprising feed lines coupled respectively to the 0° port, the 90° port, the 180° port, and the 270° port.

10. The phased array antenna of claim 9 wherein the feed lines have substantially equal length.

11. The phased array antenna of claim 7 wherein the feed substrate has a dielectric constant of at least 9.

12. The phased array antenna of claim 7 wherein the patch substrate has a dielectric constant of no more than 2.5.

13. A patch antenna comprising:

a patch made of an electrically conductive material;

a patch substrate coupled to the patch wherein the patch substrate is made of an electrically insulating material;

a ground plane coupled to the patch substrate wherein the ground plane is made of an electrically conductive material;

at least four slots formed in the ground plane;

a feed substrate coupled to the ground plane wherein the feed substrate is made of an electrically insulating material; and a hybrid network coupled to the feed substrate.

14. The patch antenna of claim 13 wherein each of the at least four slots comprises an inside edge and an outside edge wherein the inside edge extends lengthwise parallel to the outside edge between the outside edge and a center of the patch.

15. The patch antenna of claim 14 wherein each of the at least four slots is centered on a side of the patch.

16. The patch antenna of claim 15 wherein the inside edge is parallel to a side of the patch.

17. The patch antenna of claim 16 wherein the inside edge of each of the at least four slots is about 2.3 cm from the center of the patch.

18. The patch antenna of claim 17 wherein the inside edge of each of the at least four slots has a length of 2.94 cm and a width of 0.2 cm within a tolerance of 0.003 cm corresponding to a center frequency of 2 GHz.

* * * * *